US012297071B2

(12) United States Patent
Lockyer

(10) Patent No.: US 12,297,071 B2
(45) Date of Patent: May 13, 2025

(54) HOSE REEL ACCUMULATOR DRUM

(71) Applicant: Droplet IP Holdings, LLC, Sanford, FL (US)

(72) Inventor: AC Lockyer, Winter Springs, FL (US)

(73) Assignee: Droplet IP Holdings, LLC, Sanford, FL (US)

( * ) Notice: Subject to any disclaimer, the term of this patent is extended or adjusted under 35 U.S.C. 154(b) by 311 days.

(21) Appl. No.: 17/978,842

(22) Filed: Nov. 1, 2022

(65) Prior Publication Data

US 2023/0134973 A1 May 4, 2023

Related U.S. Application Data

(60) Provisional application No. 63/274,271, filed on Nov. 1, 2021.

(51) Int. Cl.
*B65H 75/44* (2006.01)

(52) U.S. Cl.
CPC ..... *B65H 75/4468* (2013.01); *B65H 75/441* (2013.01)

(58) Field of Classification Search
CPC ..... B65H 75/441; B65H 75/4402; B65H 75/4468; B65H 75/4471; B65H 75/4478; B65H 75/4492
See application file for complete search history.

(56) References Cited

U.S. PATENT DOCUMENTS

| | | | | |
|---|---|---|---|---|
| 4,315,522 | A | 2/1982 | Brown | |
| 4,506,698 | A | 3/1985 | Garcia et al. | |
| 4,513,772 | A | 4/1985 | Fisher | |
| 7,438,250 | B2 * | 10/2008 | Anderson | B65H 75/4407 242/395 |
| 8,096,317 | B2 * | 1/2012 | Uffner | B65H 75/40 74/29 |
| 8,702,026 | B2 * | 4/2014 | Evans | B65H 75/4465 242/395 |
| 8,783,597 | B2 * | 7/2014 | Nagler | B65H 75/4407 137/355.27 |
| 2014/0261766 | A1 | 9/2014 | Tracey et al. | |
| 2021/0122605 | A1 | 4/2021 | Tost et al. | |
| 2021/0276822 | A1 * | 9/2021 | Braun | F16L 3/012 |

OTHER PUBLICATIONS

International Search Report and Written Opinion, PCT/US2022/079077, dated Jan. 19, 2023, 7 pages.

* cited by examiner

*Primary Examiner* — Sang K Kim
(74) *Attorney, Agent, or Firm* — Nelson Mullins Riley & Scarborough LLP; Anthony A. Laurentano

(57) ABSTRACT

A hose and reel system that includes a reel assembly that is rotatably mounted within a housing. The reel assembly includes an accumulator drum having an inner chamber and the drum is coupled at opposite ends to disc elements. The housing can include a hose guide element for guiding a hose that is spooled about the outer surface of the drum and, if desired, a pair of mandible elements.

13 Claims, 9 Drawing Sheets

HOSE REEL ACCUMULATOR DRUM

RELATED APPLICATION

The present application claims priority to U.S. provisional patent application Ser. No. 63/274,271, filed on Nov. 1, 2021, and entitled HOSE REEL ACCUMULATOR DRUM, the contents of which are herein incorporated by reference.

BACKGROUND OF THE INVENTION

Traditional techniques for cleaning the surface of buildings and items currently exist. One traditional technique includes power washers that provide a motor and a pump for ejecting streams of heated high pressure water and other liquids, if desired, such as soap, so as to remove dirt and mildew from the surface. The combination of high pressure and temperature of the water makes it better at removing stuck on materials from the surfaces. A drawback of the power washer type systems is that they can damage the surface of the buildings and the high pressure water tends to splash or spread dirt and mildew onto other unwanted surfaces. Further, these conventional power washer systems do a relatively poor job at removing selected types of surface contaminants.

In an effort to address the foregoing drawbacks, conventional soft wash systems were developed for washing the exterior of buildings and other items. The conventional soft wash systems provide a cleaning method that uses a low pressure washing technique, along with a mixture of various liquids, such as soaps, algaecides, bleach, surfactants and water, to safely clean exterior surfaces of organic stains, mildew and algae. The conventional soft washing systems are typically used on surfaces that are notoriously hard to get clean with pressure or would be damaged if one were to use high pressure water on them, such as windows, roof shingles, screens, wood paneling, and the like. Traditional soft washing systems were originally designed for the purpose of cleaning algae off of roof shingles. The conventional soft wash systems suffer from a number of drawbacks, including poorly designed hose reels, fluid mixture systems, and the like.

A conventional spool or drum is connected at opposed ends to discs. The drum is typically connected to the discs by four long bolts that extend along the axial length of the drum and connect together the discs with the drum being captured therebetween. A fluid connection device, such as a pipe manifold, is mounted about the outer circumferential surface of drum to form a fluid inlet. A hose element is coupled to the fluid inlet and is then wound about the drum. A drawback of this design is that the external fluid connection devices are formed on the outer circumferential surface of the drum, thus making it difficult to properly wind the hose thereabout. Further, the absence of hose guides further makes it difficult to properly and cleanly wind the hose about the drum, thus subjecting the hose to unnecessary wear and tear over time.

SUMMARY OF THE INVENTION

The present invention is directed to a hose and reel system that includes a reel assembly having an accumulator drum that functions as a fluid expansion and accumulation chamber for the system. The accumulator drum can include a channel formed in an outer surface that includes a fluid port that communicates with the chamber. The fluid port can be coupled to a hose element for extracting the accumulated fluid from the chamber. The channel formed in the drum is also configured to seat a portion of the hose element such that the hose element can be easily and evenly wound about the drum.

The hose and reel system also includes a housing having a reel guide for guiding the hose element onto the drum when the reel assembly is rotated. The system can also include a pair of opposed mandible elements coupled to the housing for also guiding the hose element onto the drum if the hose element is disposed transverse to a front face of the system.

The accumulator drum employs surface features, such as cog elements, which fit into matching or complementary shaped patterns on the disc elements, which are then secured in place. The cog elements function as connection and alignment components for connecting the drum and disc elements together, while concomitantly forming a drive or torque transmittal mechanism for transmitting torque from a drive source (e.g., a handle or a motor) to the reel assembly.

The present invention is directed to a hose and reel system for dispensing a fluid comprising a housing and a reel assembly. The housing includes a base portion, first and second side panels, and a top portion. The first side panel is coupled to the base portion and has an inner surface and an outer surface and the second side panel is coupled to the base portion and also has an inner surface and an outer surface. The top portion is positioned to span between and to couple to the first and second side panels. The housing also includes a guide element disposed at a front portion of the housing and positioned so as to span between the first and second side panels. The guide element is vertically spaced apart from the base portion so as to guide a hose element when coupled to the system.

The reel assembly is rotatably mounted within the housing for winding the hose element about an outer surface. The reel assembly can include an accumulator drum and first and second disc elements that can be coupled to the drum. The accumulator drum has a main body having an outer surface that defines an inner chamber for receiving and accumulating the fluid. The main body of the accumulator drum has a first end having a first surface feature formed thereon and a second opposed end has a second surface feature formed thereon, and the main body of the drum has a channel formed in an outer surface that includes a fluid port that is fluidly coupled to the inner chamber. The first disc element is coupled to the first end of the accumulator drum and the second disc element is coupled to the second end of the accumulator drum. The first disc element has a first surface feature associated therewith that is complementary in shape to and is configured to couple with the first surface feature of the accumulator drum and the second disc element has a second surface feature associated therewith that is complementary in shape to and is configured to couple with the second surface feature of the accumulator drum. The top panel of the housing has a first flange element for coupling to the inner surface of the first side panel and an opposed second flange element for coupling to the inner surface of the second side panel.

The housing can also include a first brace element and a second brace element for coupling to the base portion and to the first and second side panels and configured to provide support to the housing. The housing can further include first and second mandible elements. The first mandible element is coupled to the first side panel and the second mandible element is coupled to the second side panel. Each of the first and second mandible elements includes a main body having a relatively flat portion that is coupled to the respective side panel and an integrally formed bent portion that extends outwardly and away from the front portion of the housing. Further, the bent portion of the first and second mandible elements are separated from each other by a separation distance that is greater than a separation distance of the first and second side panels. The first and second mandible elements guide the hose element about the accumulator drum. According to one embodiment, the surface features formed on the ends of the accumulator drum include a plurality of cog elements.

The first end region of the accumulator drum has a first fluid opening formed therein that is disposed in fluid communication with a first end of the inner chamber and the second end region has a second fluid opening formed therein that is disposed in fluid communication with a second end of the inner chamber. The fluid port is formed in the channel of the accumulator drum is disposed at or below a centerline rotational axis of the accumulator drum. The channel can include a main channel portion for seating the fluid port and a sloped transverse channel portion. The fluid port forms a fluid outlet for the inner chamber of the accumulator drum.

The first and second disc elements have a central opening formed therein. The central openings are aligned with the first and second fluid openings of the accumulator drum when the disc elements are coupled thereto. The reel assembly can also include a first flange element that is coupled to the outer surface of the first disc element. The first flange element has a central opening that is aligned with the central opening of the first disc element when coupled thereto. The second flange element is coupled to the outer surface of the second disc element. The second flange element has a central opening that is aligned with the central opening of the second disc element when coupled thereto. The flange element can also include a first conduit element that is coupled to the central opening of the first flange element, the first disc element, and the first fluid opening of the accumulator drum, and the second conduit element is coupled to the central opening of the second flange element, the second disc element, and the second fluid opening of the accumulator drum. The first and second conduit elements and the inner chamber of the accumulator drum form part of an overall fluid pathway.

The system can also include a tensioner block assembly that is coupled to the first conduit element and to the outer surface of the first side panel for providing tension to the reel assembly, and a bearing brake assembly that is coupled to the outer surface of the second side panel for providing a braking action to the reel assembly. The tensioner block assembly comprises a main housing for housing a tensioner element for providing the tension to the reel assembly and a tension adjustment element for adjusting the tension applied to the reel assembly.

BRIEF DESCRIPTION OF THE DRAWINGS

These and other features and advantages of the present invention will be more fully understood by reference to the following detailed description in conjunction with the attached drawings in which like reference numerals refer to like elements throughout the different views. The drawings illustrate principals of the invention and, although not to scale, show relative dimensions.

DETAILED DESCRIPTION

The present invention is directed to a hose and reel system that employs an accumulator drum having a sufficient volume for accumulating and holding a fluid. The hose and reel system can employ additional structural components, including hose guides, that can help the user wind the hose about the accumulator drum in an even and level manner.

As used herein, the term "hose and reel system" is intended to refer to a fluid dispensing system that includes a drum portion that is coupled to one or more side flanges or discs. The drum and/or the discs can have a fluid inlet formed therein for connection to a hose element.

Figure 1:
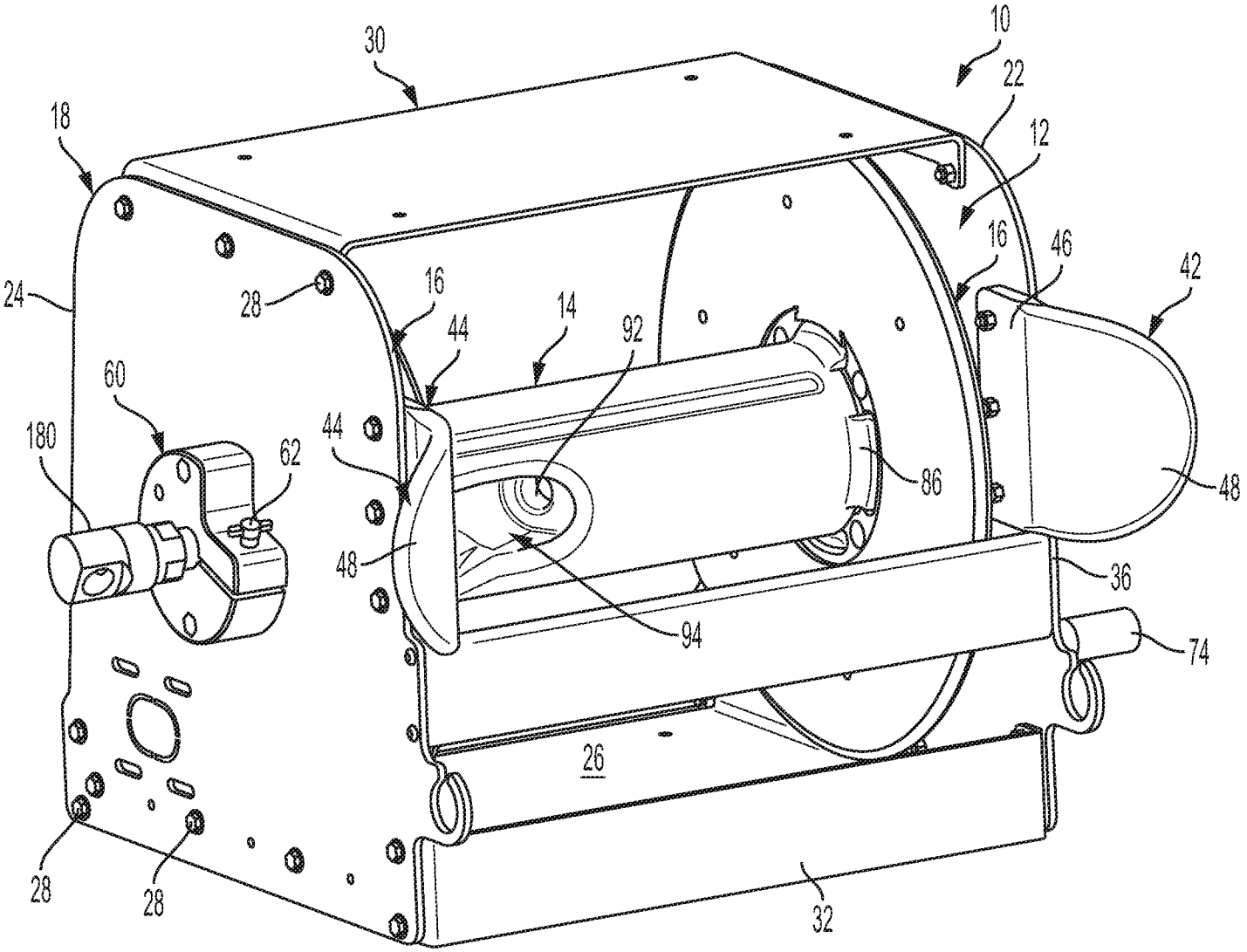
FIG. 1 is a left side perspective view of a hose and reel system according to the teachings of the present invention.
Figure 2:
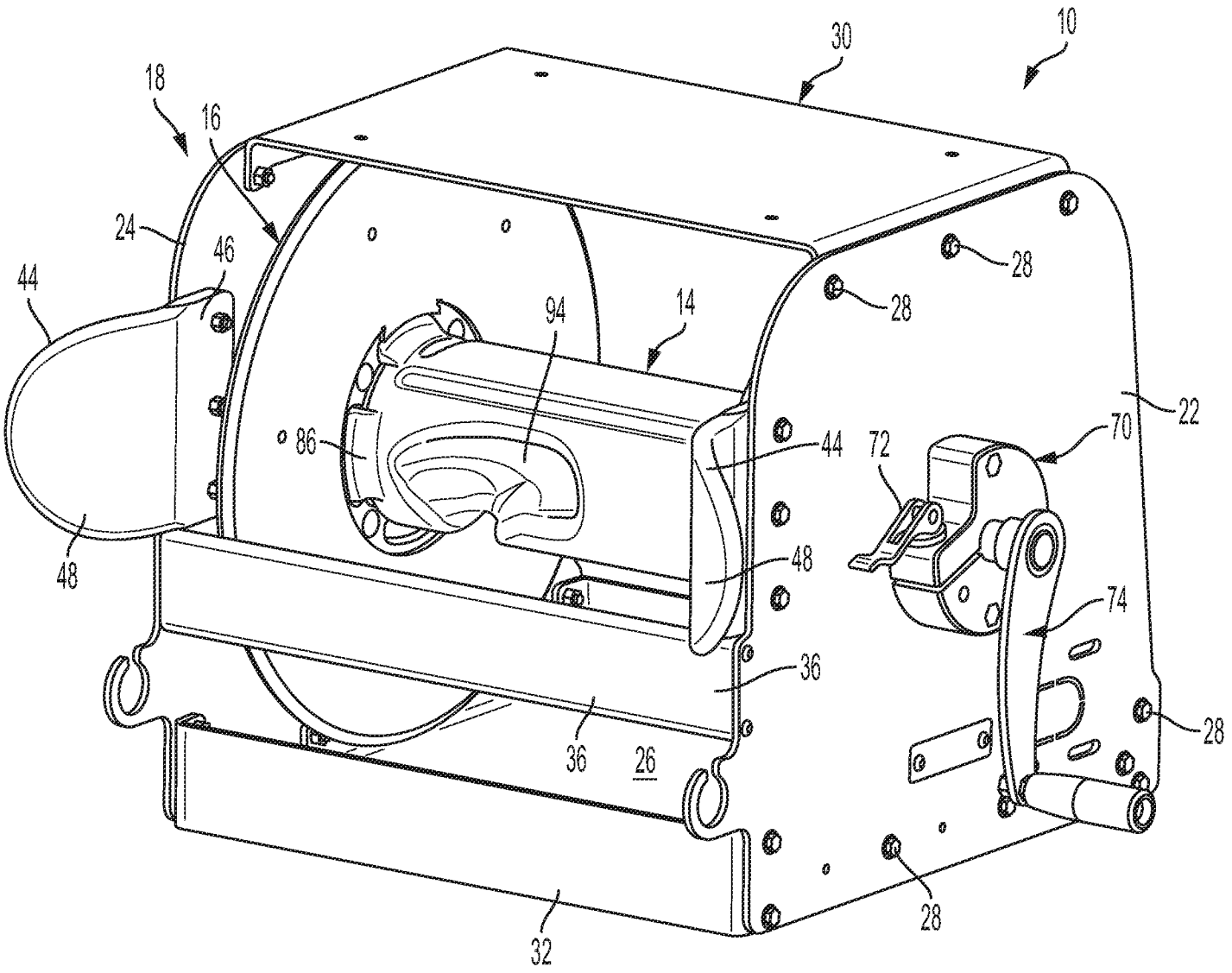
FIG. 2 is a right side perspective view of the hose and reel system according to the teachings of the present invention.
Figure 3:
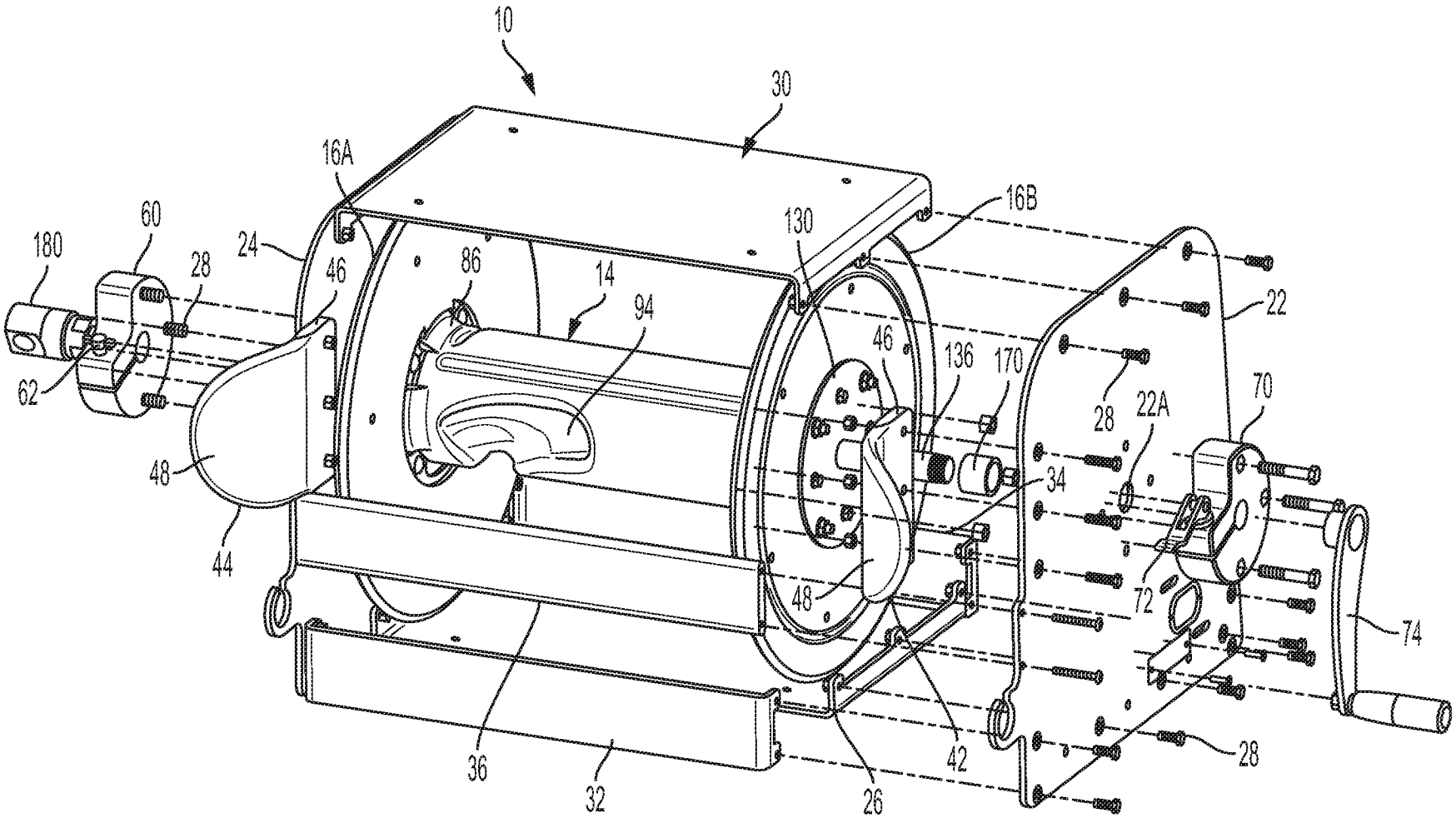
FIG. 3 is a partial unassembled perspective view of the hose and reel system according to the teachings of the present invention.
Figure 4:
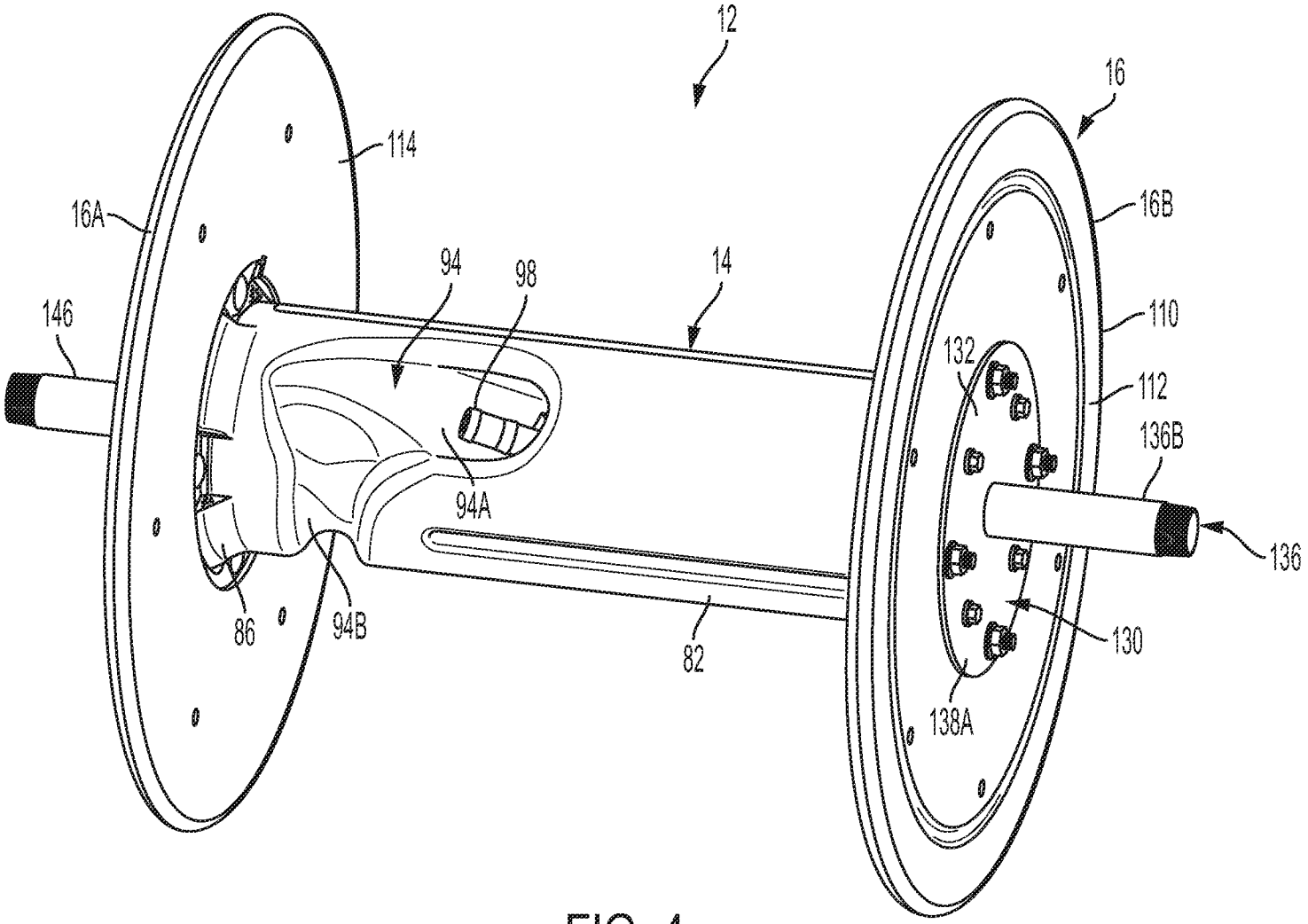
FIG. 4 is a perspective view of a reel assembly portion of the hose and reel system according to the teachings of the present invention.
Figure 5:
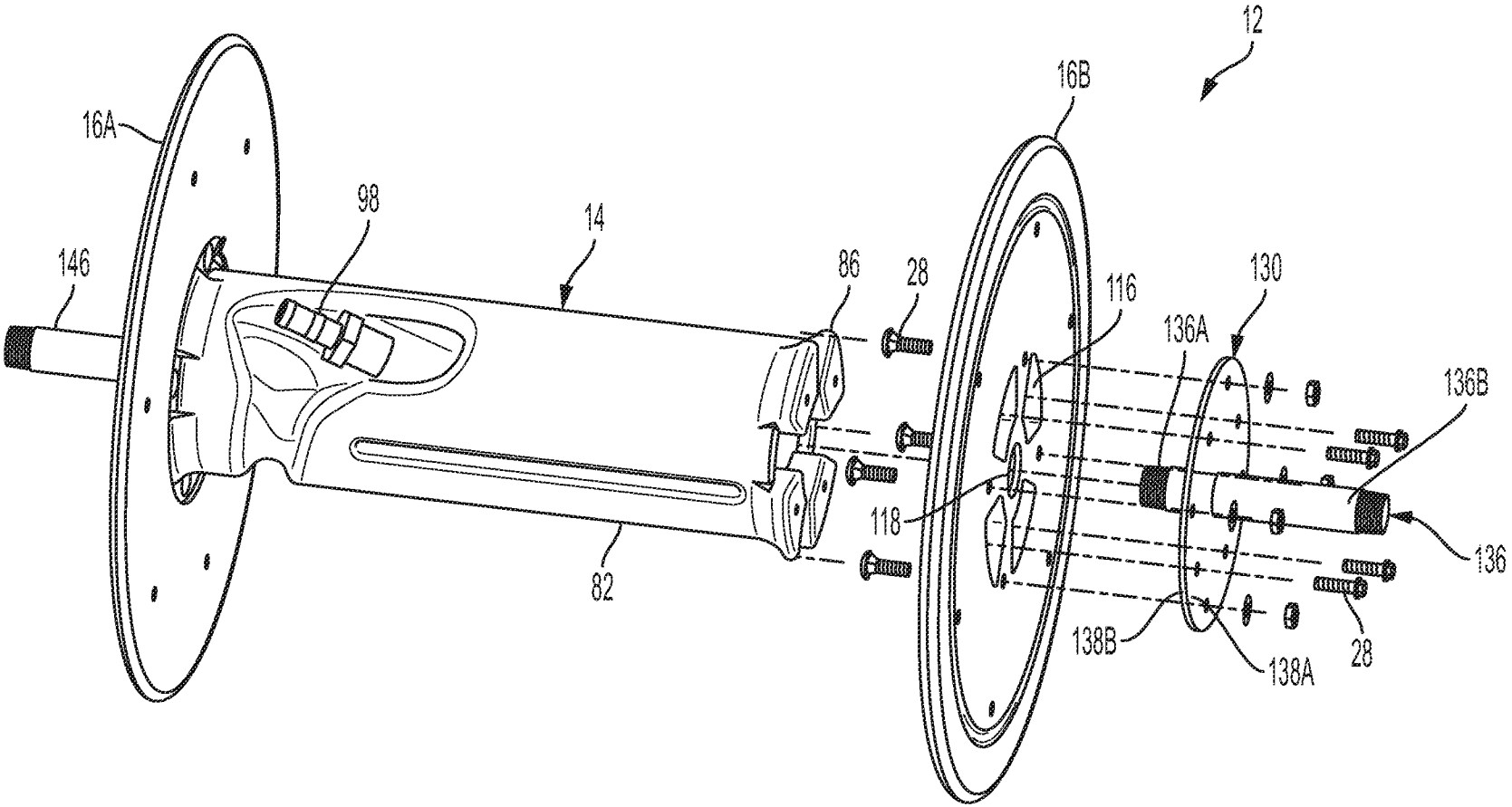
FIG. 5 is a partial unassembled perspective view of the reel assembly according to the teachings of the present invention.
Figure 6:
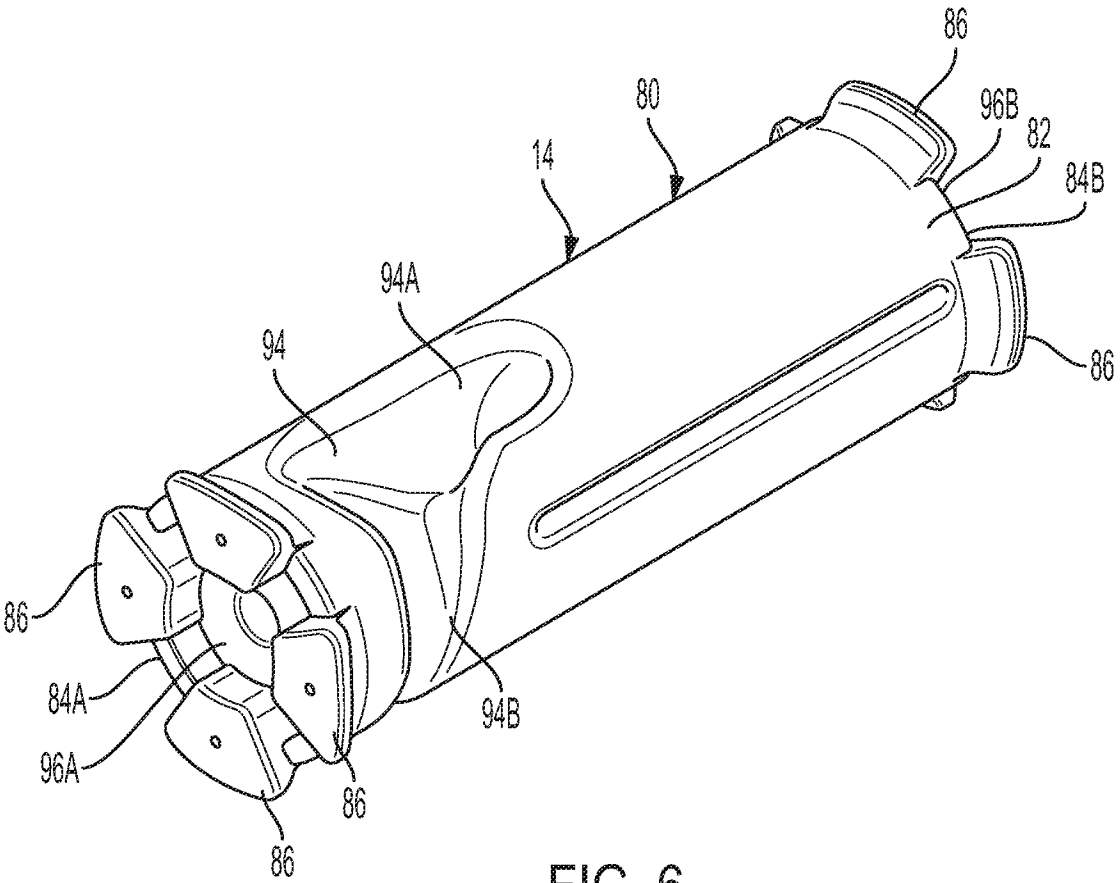
FIG. 6 is a perspective view of an accumulator drum portion of the real assembly according to the teachings of the present invention.
Figure 7B:
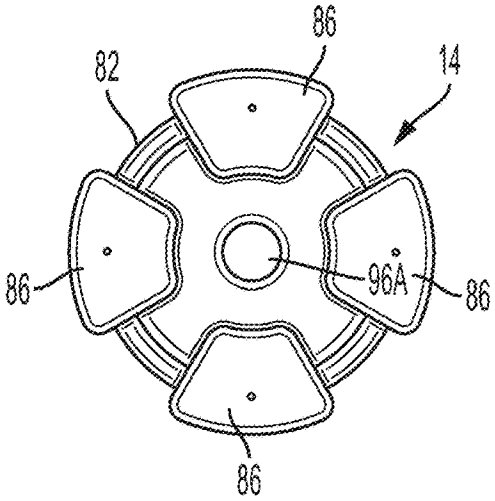
FIG. 7B is an end view of the accumulator drum according to the teachings of the present invention.
Figure 7A:
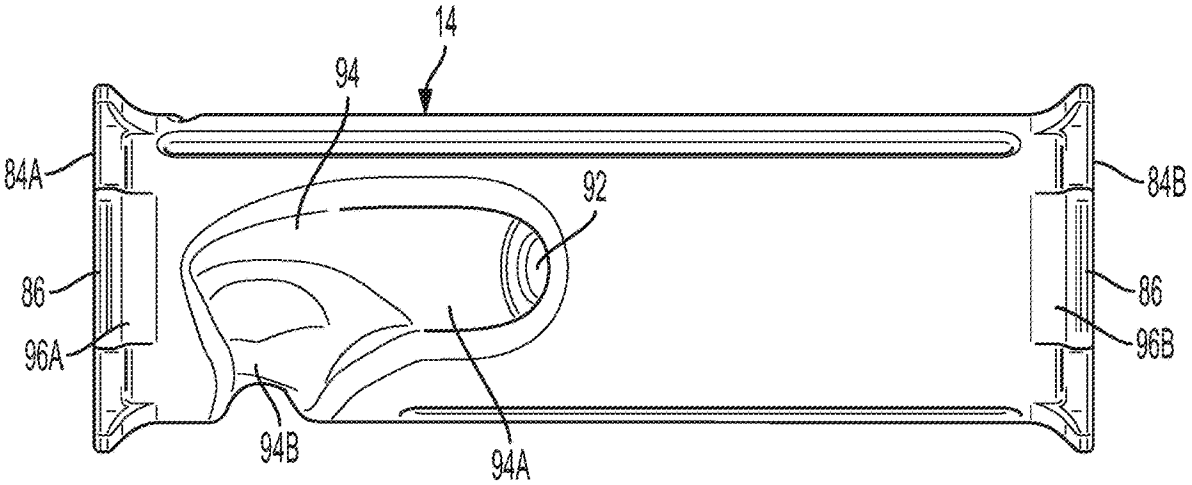
FIG. 7A is a front view of the accumulator drum according to the teachings of the present invention.
Figure 8:
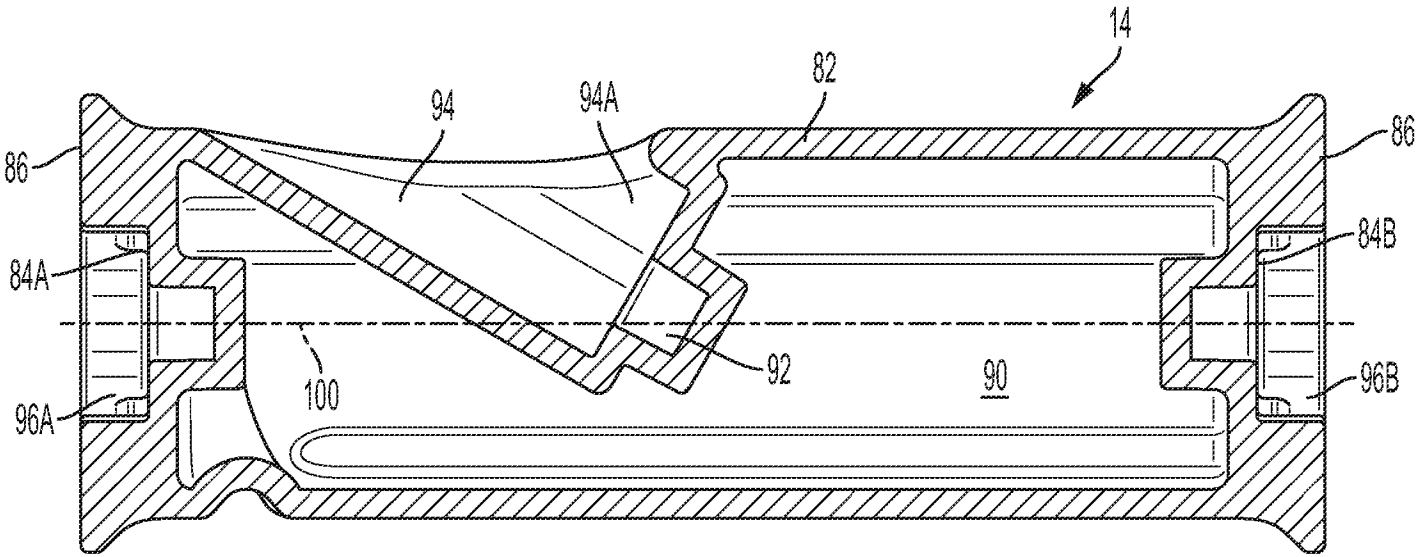
FIG. 8 is a cross-sectional view of the accumulator drum according to the teachings of the present invention.

The hose and reel system 10 of the present invention is shown in FIGS. 1-8. As illustrated in FIGS. 1-3, the illustrated hose and reel system 10 includes a reel assembly 12 that includes a drum element, such as an accumulator drum 14, that is connected to one or more reel elements, such as the disc elements 16, at opposed ends thereof. The disc elements 16 are rotatably coupled to a housing 18 for mounting the accumulator drum 14 in the housing 18. The reel assembly 12 is rotatably mounted in the housing 18 for spooling or winding a hose element about the accumulator drum 14. The accumulator drum 14 can include a fluid inlet formed at either end so that a fluid, such as water, can be introduced into an internal or inner accumulation chamber that is formed therein. The accumulator drum 14 also includes a fluid outlet formed in an outer circumferential surface thereof for allowing the fluid in the accumulation chamber to be expelled therefrom through a hose element that is coupled thereto via a hose fitting. The outlet and hose fitting are formed in a cut-out or channel portion that is formed in the outer surface of the accumulator drum.

The illustrated housing 18 can include a pair of opposed side panels 22, 24 that are secured to a base portion 26 by way of suitable fasteners 28. The housing 18 can also include a top panel 30 that is secured to and spans between the side panels 22, 24. The top panel 30 includes flange elements for coupling to the inner surface of the side panels. The top panel is relatively flat and hence forms a surface that allows multiple hose and reel systems to be stacked on top of each other. The housing 18 can further include a pair of opposed brace elements 32, 34 that are coupled to a front portion and a rear portion thereof so as to provide structural support to the housing. Specifically, the brace portions 32, 34 are coupled to the base portion 26 and to the side panels 22, 24 via the fasteners 28. The front portion of the housing 18 can also include a guide element 36 that is mounted to and spans between the side panels 22, 24. The guide element 36 is vertically spaced from the front brace element 32 by a selected distance or amount. The guide element 36 can be positioned at selected vertical positions or locations of the housing, and is preferably positioned at a vertical location that is at or near the vertical location of the accumulator drum 14. The hose guide element 36 helps guide a hose element (not shown) that is coupled to the accumulator drum 14 as the hose element is being wound or unwound from about the drum. The guide element 36 thus helps prevent uneven winding of the hose element about the drum.

The illustrated housing 18 can also include optional mandible elements 42, 44 that are secured to the side panels 22, 24. The illustrated mandible elements 42, 44 have a main body having a relatively flat portion 46 that is attached to an inner surface of the side panels 22, 24 and an integrally formed bent portion 48. The bent portion extends outwardly and away from a front face region of the housing 18. The outermost extent of the bent portions 48 of the mandible elements 42, 44 are separated from each other by a separation distance that is greater than the width or separation of the side panels 22, 24. The mandible elements 42, 44 also assist the hose element in easily winding of the hose element about the accumulator drum 14 by guiding the hose element when the hose element is pulled or located at a position that is orthogonal to the front face region of the housing 18. The bent portions 48 of the mandible elements also form a relatively smooth surface that protects the hose element, when being wound about the accumulator drum 14, from contacting and chaffing against the edges of the side panels 22, 24, thus extending the useful life of the hose element. Thus, the mandible elements help protect the hose element from unwanted wear and tear. Further, the hose element can be wound or unwound from about the accumulator drum either manually or through an automated subsystem, which can include a motor.

The housing 18 can also include suitable structure that can be coupled to either or both ends of the housing. For example, a tensioner block assembly and a bearing brake assembly can be coupled to either side panel 22, 24 of the housing 18. According to one embodiment, a tensioner block assembly 60 can be mechanically coupled to an outer surface of the side panel 24 for providing tension to the reel assembly. The tensioner block assembly 60 can include a tensioner that is housed within an external housing and can include a tension adjustment element 62. The tensioner block assembly 60 applies a force to create or maintain a selected amount of tension to the reel assembly. According to the current embodiment, the tensioner block assembly 60 can be used to create and apply tension to the reel assembly 12 so as to control and adjust the rotational speed thereof. The tensioner block assembly 60 can employ a tension adjustment element 62 for adjusting or varying the amount of tension that the assembly applies to the reel assembly 12. For example, the rotational speed of the reel assembly 12 can be increased or decreased based on the rotational position of the tension adjustment element 62. The housing 18 can further include a bearing brake assembly 70 that can be coupled to an outer surface of the side panel 22. The bearing brake assembly 70 includes bearings for assisting with rotational movement of the reel assembly 12 and can include a break element for applying a braking or stopping force to the reel assembly 12. Specifically, the bearing brake assembly 70 can also include a brake element 72 for braking or stopping the rotational movement of the reel assembly 12. The bearing brake assembly 70 can also include a handle 74 that is coupled to a housing of the bearing brake assembly. The handle 74 allows a user to manually rotate the reel assembly 12.

The reel assembly 12 of the present invention is mounted within and secured to the side panels 22, 24 of the housing 18. As shown in FIGS. 4-8, the illustrated reel assembly 12 includes the accumulator drum 14 that is coupled to disc elements 16. The accumulator drum 14 has a main body 80 having an outer surface 82 and opposed end regions 84A, 84B. Each of the end regions has two or more surface features, such as cog elements 86, formed thereon. In the illustrated embodiment, each end of the accumulator drum 14 has a series (e.g., four) of cog elements 86 formed thereon. The cog elements 86 form connection components that connect the accumulator drum 14 to the disc elements 16. The illustrated accumulator drum 14 has an inner chamber 90 formed by the main body 80. The inner chamber is sized and configured for holding or accumulating a fluid therein and has a volume that is greater than the volume typically associated with a pipe-like fluid connection component. The end regions of the drum main body 80 have an opening formed therein that communicates with the inner chamber 90. Specifically, the end region 84A of the accumulator drum 14 has an opening 96A formed therein and the end region 84B has an opening 96B formed therein. One of the openings 96A, 96B can be coupled to a fluid conduit for coupling to a fluid source and the other opening can be coupled to structure for closing or sealing off the respective end of the inner chamber 90.

The inner chamber 90 is also in fluid communication with a fluid port 92 disposed in a channel 94 that is formed in the outer surface 82 of the main body 80. The channel 94 is formed at a sufficient depth within the main body so as to locate the port 92 at or below a centerline rotational axis of the accumulator drum 14. By disposing the port at a location at or below the centerline axis 100, the port location forces any air in the inner chamber 90 vertically above the port and ensures that there is a continuous flow of fluid through the drum and into the hose element through the port 92. The channel 94 formed in the outer surface 82 can include a main channel portion 94A for seating the port 92 and a sloped transverse portion 94B. The port 92 forms or functions as a fluid outlet for the inner chamber 90. The port 92 can be coupled to a fluid connection component 98, which in turn can be coupled to the hose element. The volume of the inner chamber 90 operates as a fluid accumulator for accumulating or holding one or more fluids, or for mixing multiple different fluids, prior to exiting through the port 92. Further, the channel 94 is formed with sufficient depth and length so as to allow a connection end of the hose element to connect to the port 92 via the fluid connection component 98. The end or connection portion of the hose element, when coupled to the fluid connection component 98, can be disposed within the main channel portion 94A and exits the channel 94 via the transverse channel portion 94B. Thus, the channel portions 94A and 94B allow the hose element to be fluidly coupled to the port 92 and to the inner chamber 90 and to lie relatively flat within the channel 94 so as to allow for relatively easy winding and unwinding of the hose element from about the outer surface 82 of the accumulator drum 14. The accumulator drum 14 can be formed from any suitable material, including for example plastic (e.g., polyethylene or high density polyethylene). If longevity of the component is not a concern, then the drum can be formed from metal.

With reference again to FIGS. 3-5, the accumulator drum 14 can be coupled to the disc elements 16. The disc elements 16 can include a left disc element 16A and a right disc element 16B. Each of the disc elements 16A and 16B has a main body 110 having an outer surface 112 and an inner surface 114. The main body 110 has a series of surface features, such as apertures 116, that are formed in a central region thereof that have a shape that is complementary to the shape of the surface features formed on the ends of the accumulator drum 14. Specifically, the apertures 116 have a shape that is complementary to the shape of the cog elements 86. The cog elements 86 formed on the end region 84A of the drum 14 are disposed in the apertures 116 formed in the left disc element 16A, and the cog elements 86 formed on the end region 84B of the drum are disposed in the apertures 116 formed in the right disc element 16B. The disc elements also include an opening 118 that is formed in a central region such that when the disc elements 16 are coupled to the accumulator drum 14, the opening 118 is aligned with the openings 96A, 96B formed in the accumulator drum 14 to form a portion of the overall fluid passageway.

The reel assembly 12 also includes flange elements 130 that are coupled to the outer surface of the disc elements 16A, 16B. For example, the flange element 130 has a main body 132 having a central aperture that seats one or more conduit elements 136. The conduit element 136 can be secured to the main body 132 by known techniques, such as by welding. The conduit element 136 can be a single integral component or can be formed from multiple components that are secured to the front and rear sides of the flange element. By way of example, the conduit element 136 can extend outwardly from both the outer surface 138A and the inner surface 138B of the flange element 130. The conduit element 136 can include an outer conduit portion 136B that extends outwardly from the outer surface 138A of the flange element 130 and an inner conduit portion 136A that is coupled to the inner surface 138B of the flange element 130. The inner conduit portion 136A can be coupled to the opening 96B formed in the accumulator drum 14 either directly or through one or more additional fluid connections. The outer conduit portion 136B extends outwardly from the outer surface 138A of the flange element 130 and is adapted to pass through an aperture 22A formed in the side panel 22 and to couple to the bearing brake assembly 70. According to one embodiment, one or more spacer elements 170 can be coupled to the conduit element portion 136B, FIG. 3. The flange element 130 can be coupled to the disc element 168B through suitable fasteners 28. The disc element 16A can likewise be coupled to a flange element that has a conduit element 146 coupled thereto. The conduit element 146 has an inner portion that is configured to couple at one end to the opening 196A and to the tensioner block assembly 60 at the opposite end. The flange element can be coupled to the disc element 16A. The conduit element 146 and/or the tensioner block assembly 60 can be coupled to an inlet fluid port 180. The inlet fluid port 180 can be coupled to one or more fluid sources (not shown).

Figure 9:
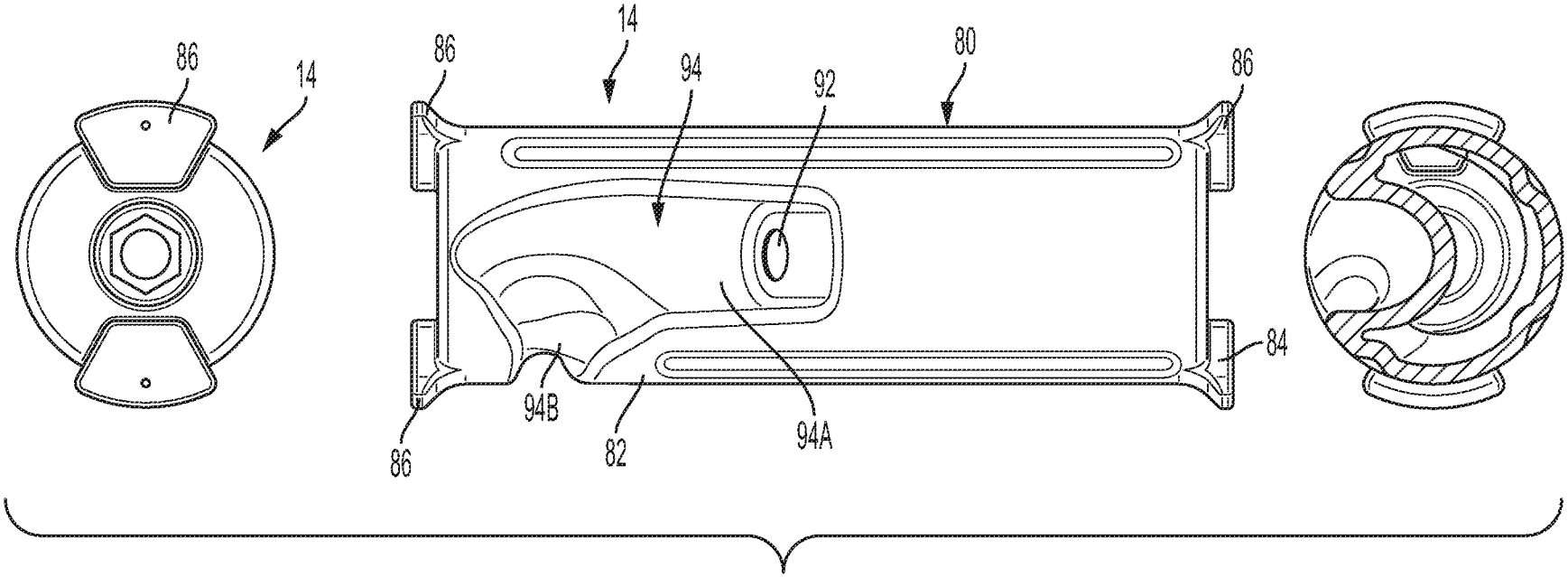
FIG. 9 is a perspective view of a second embodiment of the accumulator drum according to the teachings of the present invention.

FIG. 9 is a perspective view of another embodiment of the accumulator drum 14 of the present invention having a different number of surface features formed on the ends of the main body. Specifically, the end regions of the main body 80 can have a pair of cog elements 86 formed thereon.

In operation, the inlet fluid port 180 of the hose and reel system 10 is coupled to a fluid source for supplying a fluid thereto. The fluid can be any selected type of fluid, such as water or some other type of fluid, including an application fluid or a cleaning fluid. A hose element is coupled to the fluid connection component 98 that seats within the channel 94 and is fluidly coupled to the port 92. The hose element can be wound or spooled about the drum 14 when the drum is rotated. The hose guide element 36 and the mandible elements 42, 44 help the hose element to cleanly and evenly spool about the outer surface of the drum when the reel assembly 12 is rotated. The reel assembly can be rotated manually via the handle 74 or can be automatically rotated such as by way of a motor. The fluid connections between the inlet fluid port 180, the conduit elements 136, 136, and the accumulator drum 14 form a fluid holding and dispensing passageway or network.

As used herein, the term "application fluid" or "application fluids" is intended to include any type of fluid having a chemical mixture, solution, concentrate, solvent, solute, chemical substance, substance and the like, or combinations of the foregoing, that are mixed, suspended, or dissolved in the fluid and that can be applied or sprayed on a surface by an application element, such as a nozzle or spray wand, so as to treat a surface or a biological organism. Examples of suitable application fluids can include pesticides, insecticides, herbicides, fungicides, larvicides, mildewcides, algaecides, ovicides, plant growth inhibitors, miticides, disinfectants, defoliants, antimicrobials or microbicides, attractants, nematicides, rodenticides, cleaning solutions, and the like.

As used herein, the term "cleaning solution" or "cleaning fluid" is intended to include any conventional solvents, fluids, chemical agents, chemical substances, solvents, solutes, mixtures and solutions, concentrated or not, that can be used to clean or treat a surface. The cleaning solutions can include any combination of soaps, bleaches, degreasers, rust removers, mildewcides, fungicides, and like solutes, that can be mixed with or dissolved in a solvent, such as water. According to one practice, the cleaning solution an include biodegradable water-based chemicals.

As used herein, the term "treat" is intended to mean remove, dissolve, emulsify, destroy, control or repel a biological organism, such as algae, pests, fungus, mildew, and the like, or to clean, remove or dissolve contaminants, dirt, grime, mildew, fungus, algae, and the like from a surface.

The illustrated accumulator drum 14 of the present invention includes a plastic molded drum that replaces the need for a conventional hose reel manifold, which is typically composed of a metal pipe, with a drum having an expanded inner chamber in which spraying products are carried through the reel assembly 12 to the hose element. The accumulator drum 14 acts as a corrosion proof holding tank, thus replacing the need for a separate external manifold, as well as functions as an accumulator device, thus allowing for the expansion and contraction of the fluids being pumped from the system 10, so to keep backflow and mechanical feedback from damaging a pumps pressure switch or pump head.

The accumulator drum 14 of the present invention serves as a replacement for the typical metal reel manifolds that leak and break down during use from corrosive chemicals. The accumulator drum 14 can be sized and configured to function as a fluid expansion chamber that mitigates damaging back pressure of the head or pressure switch on a spraying system pump. As such, the accumulator drum 14 can include an inner chamber 90 having a selected size and volume suitable for providing pressure mitigation to incoming fluids. According to one practice, the chamber can be sized to hold a volume of about 144 cubic inches of liquid, although those of ordinary skill in the art will recognize that differently sized chambers can be employed that can also function as an accumulation device and pressure mitigation chamber. The accumulator drum 14 of the present invention also acts as a union of the left and right disc elements 16A, 16B on a reel assembly, by way of surface features (e.g., cog elements 86) formed or mounted on the ends of the accumulator drum, and which fit into matching or complementary shaped patterns on the disc elements, which are then secured in place. Those of ordinary skill in the art will readily recognize that other types of connections can be formed and are suitable for connecting the drum to the disc elements.

The fluid passing through the accumulator drum can be directionally flowed into the chamber from either the right or left side of the hose and reel system 10 depending on the location of the inlet fluid port 180. The accumulator drum 14 can include a channel or chamber formed in the outer surface that allows the fluid connection component 98 (e.g., output hose barb or fitting) to emerge from a non-end portion (e.g., center) of the reel assembly 14 and helps channel the hose element towards the side of the reel and align with the drum for a level wind of the hose, which is not possible with the current industry hose reel designs.

The accumulator drum 14 of the present invention thus solves the problem of chemical deterioration of a hose reel manifold by replacing a conventional metal pipe disposed through the hose reel system with a plastic chamber formed in the body of the accumulator drum for accumulating and carrying fluid. The inner chamber 90 formed in the accumulator drum 14 can also have a much larger volume relative to conventional pipes (e.g., 10× the size), thus allowing for the drum to be used as an accumulator which allows for expansion and helps take stress off the pump. In conventional systems, the accumulator drum is often a separate appliance or device that is placed between the pump and the hose reel, and is not formed in the reel assembly 14 portion of the hose and reel system 10. In the present invention, the accumulation drum 14 is formed directly into and is integral with the reel assembly 14. The accumulator drum 14 of the present invention can also include the fluid connection component 98 that is placed or positioned in the middle portion or region of the accumulator drum in a corresponding recess or chamber, thus allowing for the connecting hose element to sweep through the chamber so as to bring the hose onto the reel spool without creating a hump allowing for a cleaner level wind of the hose without creating lumps or kinks. The chamber or recess houses the fluid outlet or hose connection port that has connected thereto a hose fitting. The hose fitting seats within the recess. Further, the connection port extends inwardly and terminates in an opening, once tapped, that is positioned about an axial centerline of the accumulator drum. This opening position allows air to be trapped above the opening during use, and hence provides for a relatively steady flow of fluid from the fluid source, through the drum, and then through the attached hose. The connection port also provides a means to mix fluids introduced through other ports formed therein. The additional ports can be formed at the axial ends of the drum.

Further, traditional pipe manifolds extend all the way through the reel assembly and are hard to maintain, replace and corrode easily because of welds and threads formed therein. Additionally, the traditional manifolds extend upwards from the reel assembly creating a bump or lump in the hose element, thus making it difficult to perform a level wind of the hose element about the reel main body. The 90 degree extension of the traditional manifold is then used to catch on the PVC spool as the manifold becomes the drive mechanism for the reeling/collection of the hose.

The present invention is also directed to a reel guide for hose and reel systems. Traditional reel guides are bulky stainless steel rollers with heavy brackets that detract from the sleek design of a reel but also unnecessarily protrude from the reel housing. The reel guides of the present invention are fixed in place, relatively low weight, and can be formed from plastic.

The hose and reel system 10 of the present invention also employs assemblies coupled to the side plates that do not extend through the reel assembly, but rather are separate and distinct. The tensioner block assembly 60 can be employed on one side of the hose and reel system 10 and the brake assembly 70 can be employed on the opposed side of the system. The block and brake assemblies can be configured to be universal and are coupled to the housing 18 and to the flange element 130 and to the disc elements 16. The rotation of the reel assembly 14 can be performed by a handle 74 (e.g., hand crank) or by a motor and chain assembly, and can be configured to transfer that drive to the disc elements 16 through the manifold flange. Conventional reel systems have a flange but only utilize the flange for centering the reel. The flange elements 130 of the present invention serve to center the reel assembly 14 within the housing 18 and to transfer the torque of the handle 74 and/or motor to the disc elements 16.

The disc elements 16 can also include a pair of alignment components that are formed in the disc for assembly as well as transferring drive or torque from one side of the reel to the other during winding. The disc element, for example, can include multiple cog elements 86 formed at the end regions.

In conventional reels, a spool is provided in the center of the reel assembly. The reel system then employs four long headless bolts to draw the left and right spools together. Alignment of the left and right spools, centering and consideration of the manifold exiting the spool in the right area are difficult to accomplish. The reel assembly 12 of the present invention address this issue by creating a surface features, such as cog elements 86, on the ends of the accumulator drum 14 that are configured to couple to the disc elements 16 and the flange elements 130 of the reel assembly 12. The mating engagement of the cog elements 86 and the disc elements 16 align and connect together the disc elements and the accumulator drum, as well as to transmit torque across the reel assembly without relying on a traditional external manifold.

The reel assembly 14 of the present invention can also include reversable or universal motor mounts for right to left orientations. The reel assembly can also include relatively flat reversable side plates that do not include surface features that limit the sides to being solely a left side or a right side. The sides of the reel stand are universal right or left without a rolling orientation (e.g., spinning 180 degrees so that the motor position rolls from rear to front). The sides of frame of the reels of the present invention pass along a right to left plane allowing the motor position to remain in the rear of the reel. This is significant where multiple reels are in use and the user or end purchaser/installer can easily move electric drive motor systems from the left side of the reel (as shipped) to the right side of the reel (e.g., customized) for stacking as well as side-by-side applications.

It will thus be seen that the invention efficiently attains the objects set forth above, among those made apparent from the preceding description. Since certain changes may be made in the above constructions without departing from the scope of the invention, it is intended that all matter contained in the above description or shown in the accompanying drawings be interpreted as illustrative and not in a limiting sense.

It is also to be understood that the following claims are to cover all generic and specific features of the invention described herein, and all statements of the scope of the invention which, as a matter of language, might be said to fall therebetween.

I claim:

1. A hose and reel system for dispensing a fluid, comprising a housing having a base portion, a first side panel coupled to the base portion and having an inner surface and an outer surface and an opposed second side panel coupled to the base portion and having an inner surface and an outer surface, a top portion positioned to span between and to couple to the first and second side panels, and a guide element disposed at a front portion of the housing and positioned so as to span between and be coupled to the first and second side panels, wherein the guide element is spaced apart from the base portion so as to guide a hose element when coupled to the system, a reel assembly rotatably mounted within the housing for winding the hose element thereabout, the reel assembly having an accumulator drum having a main body having an outer surface that defines an inner chamber for receiving and accumulating the fluid, the main body of the accumulator drum having a first end having a first surface feature formed thereon and a second opposed end having a second surface feature formed thereon, and wherein the main body has a channel formed in an outer surface thereof and includes a fluid port that is fluidly coupled to the inner chamber, a first disc element coupled to the first end of the accumulator drum and a second disc element coupled to the second end of the accumulator drum, wherein the first disc element has a first surface feature associated therewith that is complementary in shape to and is configured to couple with the first surface feature of the accumulator drum and wherein the second disc element has a second surface feature associated therewith that is complementary in shape to and is configured to couple with the second surface feature of the accumulator drum, wherein the housing further includes a first mandible element coupled to the first side panel and a second mandible element coupled to the second side panel, wherein each of the first and second mandible elements includes a main body having a relatively flat portion that is coupled to the respective side panel and an integrally formed bent portion, wherein the bent portion extends outwardly and away from the front portion of the housing.

2. The system of claim 1, wherein the top panel has a first flange element for coupling to the inner surface of the first side panel and an opposed second flange element for coupling to the inner surface of the second side panel.

3. The system of claim 1, wherein the housing includes a first brace element and a second brace element for coupling to the base portion and to the first and second side panels and configured to provide support to the housing.

4. The system of claim 1, wherein the bent portion of the first and second mandible elements are separated from each other by a separation distance that is greater than a separation distance of the first and second side panels, wherein the first and second mandible elements guide the hose element about the accumulator drum.

5. The system of claim 4, wherein the surface features formed on the first and second ends of the accumulator drum includes a plurality of cog elements.

6. The system of claim 5, wherein the first end region of the accumulator drum has a first fluid opening formed therein that is disposed in fluid communication with a first end of the inner chamber and the second end region has a second fluid opening formed therein that is disposed in fluid communication with a second end of the inner chamber.

7. The system of claim 6, wherein the fluid port formed in the channel of the accumulator drum is disposed at or below a centerline rotational axis of the accumulator drum.

8. The system of claim 7, wherein the channel comprises a main channel portion for seating the fluid port and a sloped transverse channel portion, wherein the fluid port forms a fluid outlet for the inner chamber.

9. The system of claim 8, further comprising a fluid connection component for coupling to the fluid port, wherein the fluid connection has an end configured for coupling to the hose element.

10. The system of claim 9, wherein each of the first and second disc elements has a central opening formed therein, wherein the central openings are aligned with the first and second fluid openings of the accumulator drum when the disc elements are coupled thereto, wherein the reel assembly further comprises a first flange element coupled to the outer surface of the first disc element, wherein the first flange element has a central opening that is aligned with the central opening of the first disc element when coupled thereto, a second flange element coupled to the outer surface of the second disc element, wherein the second flange element has a central opening that is aligned with the central opening of the second disc element when coupled thereto, a first conduit element that is coupled to the central opening of the first flange element, the first disc element, and the first fluid opening of the accumulator drum, and a second conduit element that is coupled to the central opening of the second flange element, the second disc element, and the second fluid opening of the accumulator drum, wherein the first and second conduit elements and the inner chamber of the accumulator drum form part of an overall fluid pathway.

11. The system of claim 10, further comprising a tensioner block assembly coupled to the first conduit element and to the outer surface of the first side panel for providing tension to the reel assembly, and a bearing brake assembly coupled to the outer surface of the second side panel for providing a braking action to the reel assembly.

12. The system of claim 11, wherein the tensioner block assembly comprises a main housing for housing a tensioner element for providing the tension to the reel assembly and a tension adjustment element for adjusting the tension applied to the reel assembly.

13. The system of claim 12, further comprising a handle element that is coupled to the bearing brake assembly for rotating the reel assembly.

* * * * *